US005115736A

United States Patent [19]

Rodolico et al.

[11] Patent Number: 5,115,736

[45] Date of Patent: May 26, 1992

[54] COMPACTION CONTAINER FOR DOMESTIC SOLID WASTE

[76] Inventors: Alberto Rodolico, Via Micheli 12,, Florence, Italy; Antonino Rodolico, 624 Erskine Dr., Pacific Palisades, Calif. 90272

[21] Appl. No.: 605,508

[22] Filed: Oct. 30, 1990

[51] Int. Cl.[5] ..... B30B 1/24; B30B 1/04

[52] U.S. Cl. ..... 100/90; 74/109; 100/226; 100/229 A; 100/240; 100/245; 100/288; 403/109; 403/110; 403/322

[58] Field of Search ..... 100/90, 125, 229 A, 100/240, 245, 247, 257, 274, 275, 276, 277, 288, 226; 74/109, 110, 531; 403/109, 110, 322

[56] References Cited

U.S. PATENT DOCUMENTS

| | | | |
|---|---|---|---|
| Re. 15,285 | 2/1922 | Lebherz | 100/288 |
| 404,360 | 5/1889 | McClellan | 100/245 |
| 678,965 | 7/1901 | Middleton | 100/275 |
| 970,566 | 9/1910 | Spencer | 100/125 |
| 1,400,556 | 12/1921 | Krus | 100/288 |
| 1,489,452 | 4/1924 | Napolis | 74/109 |
| 3,731,618 | 5/1973 | Leman | 100/288 |
| 4,043,691 | 9/1977 | Fukino | 403/322 |
| 4,148,255 | 4/1979 | McQueen | 100/247 |
| 4,387,637 | 6/1983 | Baird | 100/288 |
| 4,991,500 | 2/1991 | Knapp | 100/245 |

FOREIGN PATENT DOCUMENTS

| | | | |
|---|---|---|---|
| 260391 | 5/1965 | Australia | 403/110 |
| 2434286 | 1/1976 | Fed. Rep. of Germany . | |
| 2553662 | 6/1977 | Fed. Rep. of Germany . | |

*Primary Examiner*—Harvey C. Hornsby
*Assistant Examiner*—Terrence R. Till
*Attorney, Agent, or Firm*—McAulay Fisher Nissen Goldberg & Kiel

[57] ABSTRACT

A cylindrical container and cover to be firmly fitted thereon with a bayonet coupling and supports for a lever multiplier to supply to a rack rod a force "n" times stronger than the one applied to the levers, the lever multiplier being integral with a cylinder which slides inside a housing with cuts fitted in the cover center to allow a constant compression according to the heap height; force is transmitted onto the waste to compress it with a piston, which is firmly connected with a nut to the lower part of the rack rod.

20 Claims, 3 Drawing Sheets

COMPACTION CONTAINER FOR DOMESTIC SOLID WASTE

The invention refers to a compaction container for domestic solid waste, the incumbered volume of which is reduced to consistently increase the reception capacity of the containing part of the device, thus allowing longer filling times and/or the utilization of smaller containers. The invention starts from the presupposition that, at present, these waste in great part consist of paper and plastic materials, such as packing components, wrapping materials and lost containers, as well as newspapers, materials which cause considerable encumbering, when freely collected, and small weight, while the presence of air in the wide interspaces acts as a degradation hastener of the organic substances contained in the refuse materials and cause bad smells. The invention, by extracting the air interposed in the waste, avoids this inconvenience by carrying out a compacted block consisting of inert parts that keep back the interposed organic ones in bond condition. This compacted block, lodged in an a impermeable bag, previously fitted in the container, is then brought to be discharged.

A version of the invention is illustrated, in a merely indicative way, in the drawings of the sheets 1, 2 and 3. With reference to sheet 1, FIG. 1 is the longitudinal section of the operative assembly, and the piston 9 can be observed, in its upper position in hatched view, and in its lower position in dot-dashed outline.

FIG. 4 is a view of the devices carrying out the operation of the rack rod 7, while

Figure 1:
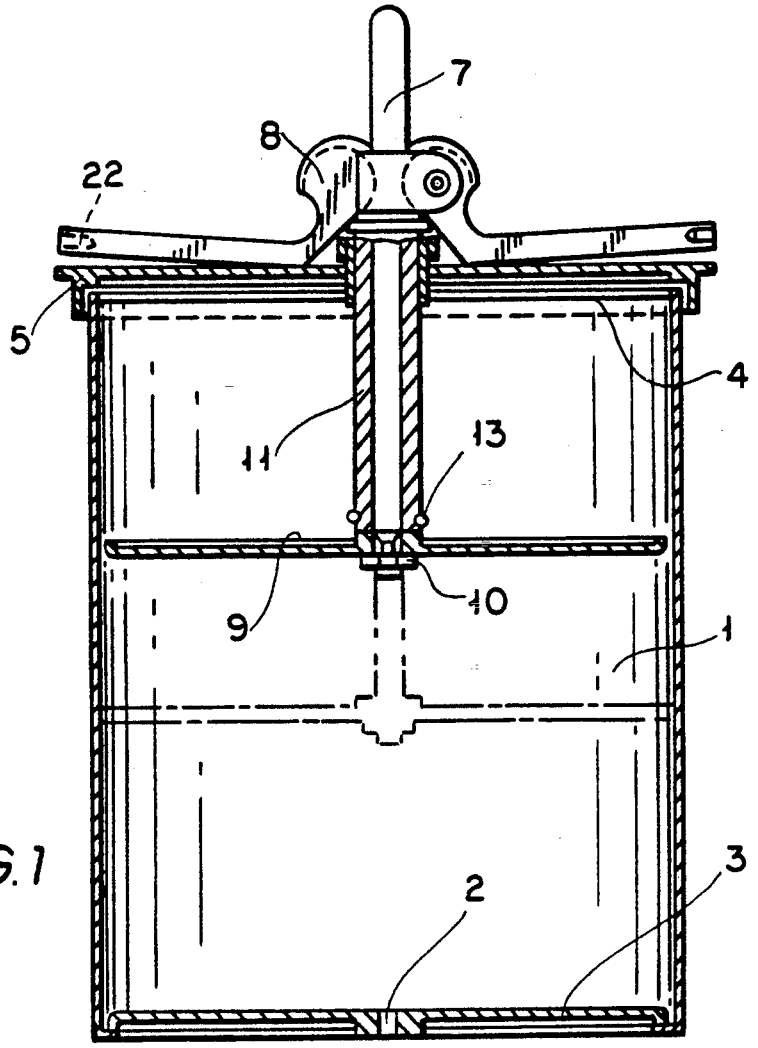

Substantially, the device consists of a cylindrical container 1 with bore 2 on the bottom 3 and upper inlet provided with an edge 4 and shut by a cover 5 to be firmly fitted on the container by means of four bayonet couplings 6. On the said cover 5, a lever multiplier is fitted, by means of which on a rack rod 7 and "n" times stronger force is applied in comparison with the one on the levers 8. Such force is transmitted to the material to compress by means of a piston 9 which is firmly connected, by means of the nut 10, to the lower part of the rack rod 7. The multiplier mechanism is integral with a cylinder 11, which slides into a housing 12 or guide notches with cuts, fitted in the center of cover 5 so as many are the heights or various heights from which the compression can be performed again. A stroke gain is thus obtained which can be used until the space foreseen in the container 1 is completely filled. In the intermediate compression positions, the cylinder 11 is prevented from dehousing by a system of O-ring limit seats 13. The slip of the cylinder 11 is checked and controlled by a quickly released rabbet or tube clamp 14 to check the exceeding or any excessive force, if any, which could be inadvertedly exerted on the levers 8. The multiplier mechanism consists of two counterposed levers 8 which are intergral with wheels, with lowered flat involute gear teeth, which transmits the movement to a double gear teeth of the same type obtained on the rack rod 7. These levers, at the end of which some lug bolts are fitted to catch then more easily, and the gear wheels can rotate by approximately 210° on a pivot turning with them. This pivot is positioned in the fixed part of the sliding cylinder 11 on which fixed part it is blocked by means of a self-tapping screw 15 with washer 16. The complete rotation of the levers 8 lets the rack rod 7—contained in the sliding cylinder 11—slide downwards. With a view to allowing an easy extraction of the material after its compression, some tolerance is foreseen between the piston 9 and the container 1, so that a soft and resistant plastic material bag can be inserted, whose upper part will be kept back or retained by the gasket 17 of the cover 5 when closing. The container 1 is also fitted with feet 18 to facilitate the operator to keep it back on the ground. The bail clamp 19*a* is kept tightened on opposite lugs 20*a* by means of a threaded pin 19 and nut 20 and handle 21 which, when closed, keeps in position an eccentric cam. By bringing this handle 21 into its opened position, the eccentric cam is brought outwards and the cylinder 11 is allowed to move or travel. By properly calibrating the nut 20, it is possible to rate the circling force in order to avoid breaks or ruptures due to or owing to exceeding pressure and to allow use of the whole available space.

Figure 2:
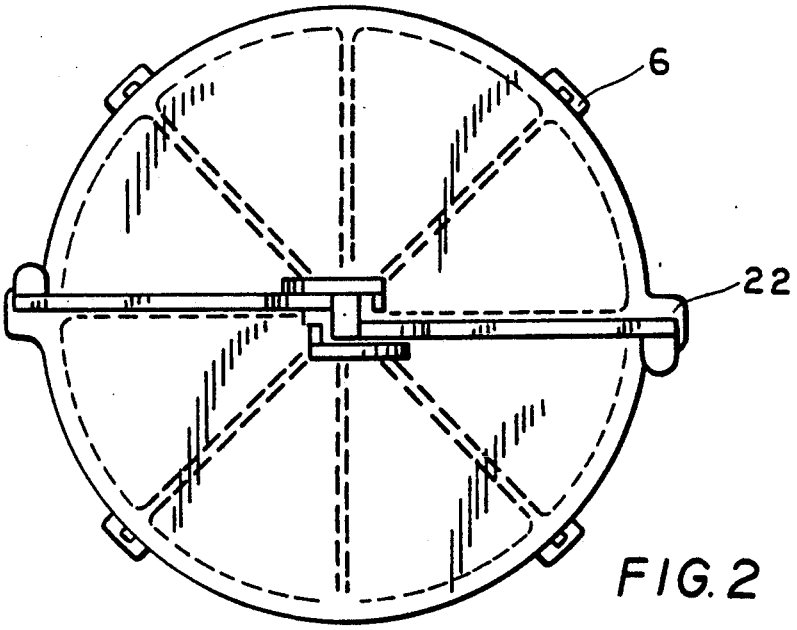
FIG. 2 is a view from above of the device according to the invention.
Figure 3:
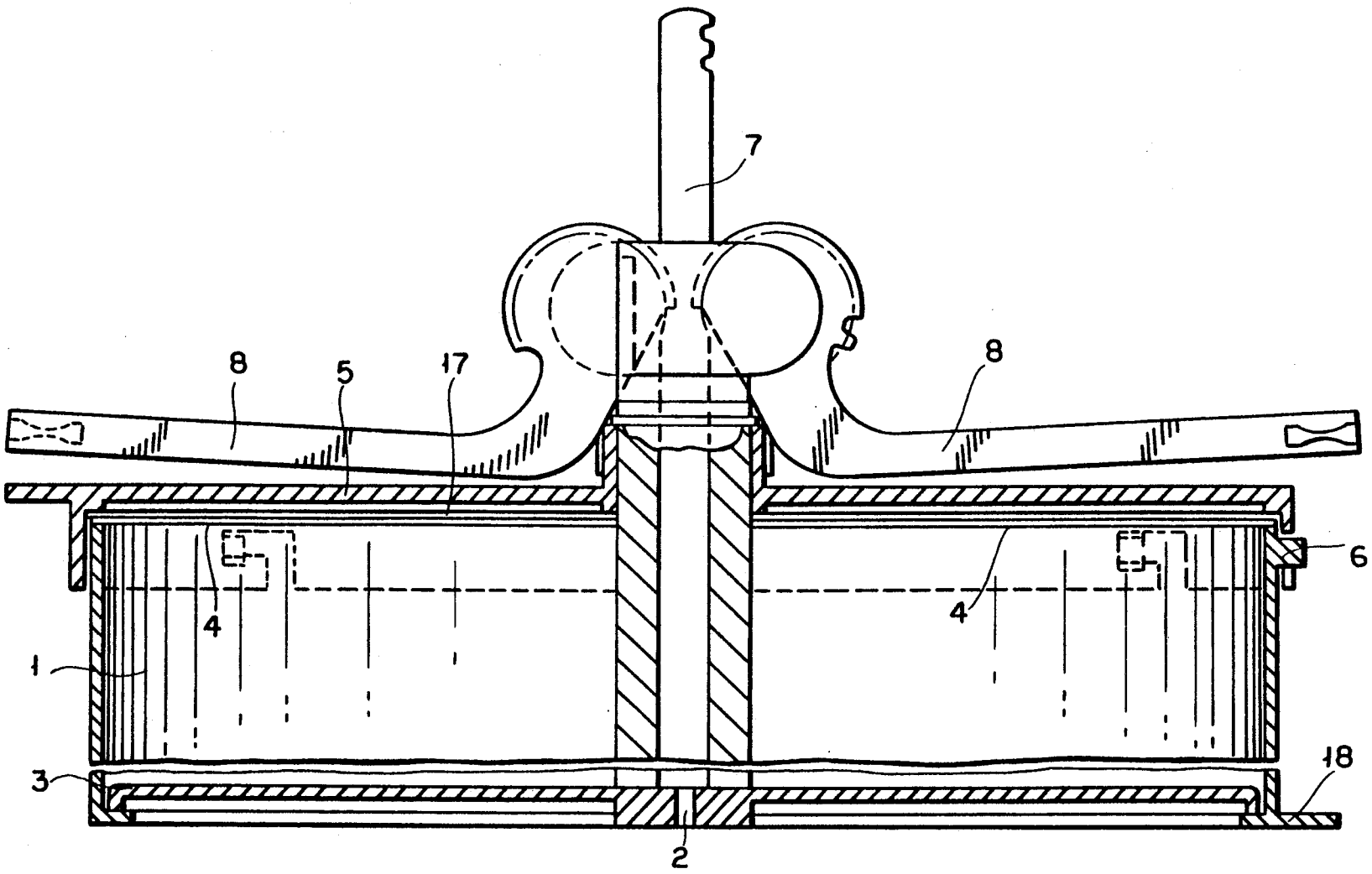
FIG. 3 is a longitudinal sectional view showing the compacting device fitted on the cover.
Figure 4:
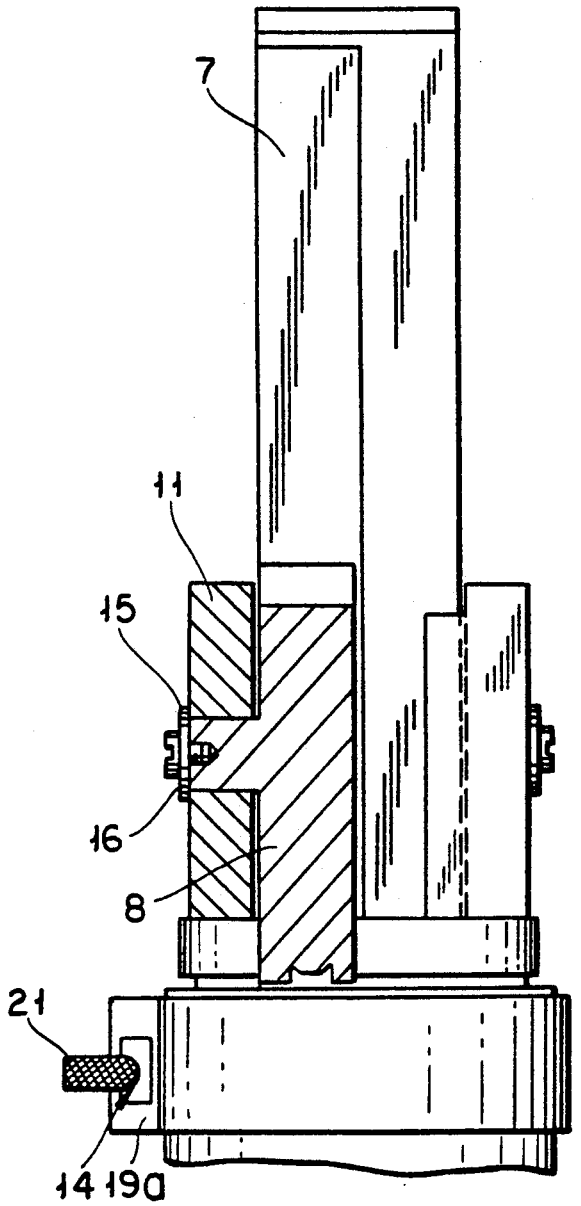
Figure 5:
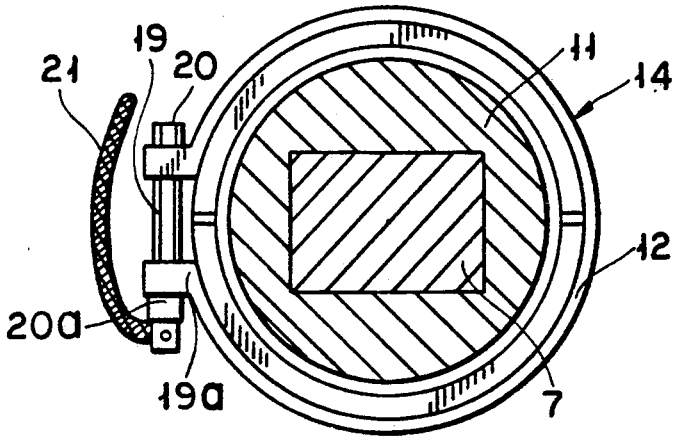
FIG. 5 is a view of the disengaging device for the cover.

To use the counterposed clutches or joints 22 (see FIG. 2) with the hands, the cover 5 is disengaged from the compacting device is unhooked and brought raised up to allow the container 1 to accede and the different waste put in. This assembly is then fitted again by turning the two counterposed or diagonally opposite levers 8, with handle catch on them. The crossed levers 8 and the rack rod 7 are activated and which, by sliding downwardly, brings the piston 9 into position to compress the waste. To put in more waste, the cover assembly 5 is taken out and the pressing condition of the heap in the container 1 is restored. To draw out the waste, the bag is closed, which was retained in opposition between the seal 17 of the cover and the edge 4 of the container, and is extracted while the depression or suction air enters through the bore 2 of bottom 3.

Before closing the device, the invention foresees, each time, a covering surface means on the waste heap, either in paper of plastic, to act as a fender or separator between the waste and the piston 9 to avoid to soil it.

We claim:

1. A compaction container assembly for domestic solid waste, said assembly including:

a container and a cover therefor, said container having an upper inlet and being adapted to receive therein a plastic impermeable waste material bag which is removable from said container, said bag having an entrance opening for insertion of waste into the bag for compacting the waste within said bag and extracting air therefrom for preventing degradation;

said container being substantially cylindrical in shape and said upper inlet defining an edge through which said bag is inserted into and extracted from said container, said container having a base provided with a bore through which air passes to allow air into said container while said bag is being extracted from said container;

cooperative sealing means on said cover and said container for sealing said cover to said container including a first bayonet seal on said cover and a second bayonet seal on said container cooperating with said first bayonet seal;

said cover having a cover opening therethrough for allowing movement of a compaction assembly means in said container with said cover thereon while being firmly held to said container by said first and said second bayonet seals;

said compaction assembly means including a piston for compaction of waste material in the bag coupled with a rack rod assembly for movement of said piston vertically along a central axis of said container and a lever multiplier coupled with said rack rod assembly for producing increased force and imparting the same to said rack rod assembly;

said rack rod assembly being coupled with said piston and said cover for vertically positioning said piston for movement into and out of said container axially, and said rack rod assembly extending into said container through said cover opening for causing said piston to compact refuse in said bag within said container;

said piston fitting into said bag through said entrance opening thereof, said entrance opening being coincident with the edge of said container for enabling said piston to exert pressure onto the waste material for compression thereof in said bag to extract air therefrom, the air in said bag being interposed in the waste while said bag is in said container;

setting and compacting means, coupled with said rack rod assembly for causing said piston in response to said lever multiplier to slide downwards together with said rack rod assembly into said bag for compacting of the refuse in said bag, including a cylinder unit slidable into said container through said cover opening and being integral with said lever multiplier, said cylinder unit positioning said rack rod assembly axially of said container and having different compression heights provided by different compression positions;

O-ring—type limit seats operatively associated with said cylinder unit for preventing said cylinder unit from being dislodged at the different compression positions; and quick release means operatively associated with said rack rod assembly for limiting effects of exceeding forces inadvertently imparted to said lever multiplier, and for disengaging said cylinder unit from said cover.

2. The cylinder according to claim 1, wherein said rack rod assembly includes a rack rod axially aligned with said bore.

3. The container according to claim 1, including a nut coupling said piston to said rack rod assembly.

4. The container according to claim 1, including pivoting means fitted into the center of said cover cooperating with said lever multiplier to permit said piston to effect compression of the waste in said bag at different heights.

5. The container according to claim 4, including a self-tapping screw for fixing said pivoting means onto said sliding cylinder unit.

6. The container according to claim 1, wherein said lever multiplier is operatively associated with said rack rod assembly and includes two counterposed levers for movement of said rack rod assembly.

7. The container according to claim 1, wherein said rack rod assembly includes double gears having involute gear teeth, and said lever multiplier includes two flat involute gears having gear teeth cooperating with said rack rod assembly involute gear teeth for transmitting motion to said rack rod assembly, and two counterposed levers coupled with said two flat involute gear teeth for turning thereof.

8. The container according to claim 7, wherein said levers rotate said gear teeth through an arc of 120°.

9. The container according to claim 8, wherein said quick release means includes a threaded pivot and a nut therefor, a rail on said rack rod assembly and a handle coupled with said threaded pivot for holding said rail in position on said rack rod assembly when closed and permitting said cylinder unit to move.

10. The container according to claim 1, wherein the plastic bag is a soft plastic bag.

11. The container according to claim 1, including a seal interposed between said cover and said open top of said container for holding a top portion of the plastic bag along the edge of said container.

12. The container according to claim 1, wherein said quick release means includes a threaded pivot and a nut therefor, a rail on said rack rod assembly and a handle coupled with said threaded pivot for holding said rail in position on said rack rod assembly when closed and permitting said cylinder unit to move.

13. The container according to claim 1, wherein said bore cooperates with said container to facilitate extraction of said bag with compacted refuse waste therein by allowing the depression air to get into said container and cooperating with said bag to enable said bag to be easily removed from said container.

14. The container according to claim 1, including a spacing tolerance between said piston and said cylindrical container to avoid a tear in said plastic bag and to allow air contained in the compacted refuse waste to get out of said plastic bag during compacting operation.

15. The container according to claim 1, including feet fitted onto a base of said container to enable an operator to retain the container on the ground.

16. The container according to claim 1, including means to adjust and calibrate said nut to adjust the circling force and to avoid breaks due to exceeding pressure.

17. The container according to claim 1, including a covering surface for said container between said cover and said container to operate as a diaphragm between the waste and said cover, thus avoiding soiling thereof.

18. The container according to claim 1, wherein said quick release means includes a bail tightened onto said slidable cylinder.

19. The container according to claim 18, including means for keeping said bail closed on counterposed approaching lug bolts, said quick release means includes a threaded pivot, a nut and a handle which, when closed, keeps an eccentric in position, and brings said handle into an opened position, the eccentric being moved out of place and said cylinder being permitted to slide.

20. The container according to claim 1, wherein said lever multiplier is integral with said slidable cylinder means.

* * * * *